US008752241B2

(12) United States Patent
Woerwag

(10) Patent No.: US 8,752,241 B2
(45) Date of Patent: Jun. 17, 2014

(54) VACUUM CLEANER NOZZLE WITH MAGNETIC LOCK

(75) Inventor: Peter Woerwag, Staad SG (CH)

(73) Assignee: Duepro AG, Romanshorn (CH)

( * ) Notice: Subject to any disclaimer, the term of this patent is extended or adjusted under 35 U.S.C. 154(b) by 335 days.

(21) Appl. No.: 13/267,831

(22) Filed: Oct. 6, 2011

(65) Prior Publication Data

US 2012/0090131 A1 Apr. 19, 2012

(30) Foreign Application Priority Data

Oct. 6, 2010 (DE) ..... 10 2010 038 026

(51) Int. Cl.
*A47L 9/00* (2006.01)
*A47L 9/10* (2006.01)

(52) U.S. Cl.
USPC ..... 15/351; 15/410; 15/411

(58) Field of Classification Search
CPC ..... A47L 9/00; A47L 9/10
USPC ..... 15/351, 410, 411
See application file for complete search history.

(56) References Cited

U.S. PATENT DOCUMENTS

| | | | |
|---|---|---|---|
| 882,574 | A | 3/1908 | Moukos |
| 1,072,607 | A | 9/1913 | Guthorn |
| 1,086,367 | A | 2/1914 | Hope |
| 1,139,736 | A | 5/1915 | Stabel |
| 1,161,908 | A | 11/1915 | Tice |
| 2,038,697 | A | 4/1936 | Winslow |
| 2,162,313 | A | 6/1939 | McCabe et al. |
| 2,170,963 | A | 8/1939 | Dahl |
| 2,203,088 | A | 6/1940 | Hansson |
| 2,246,438 | A | 6/1941 | Hedlund |
| 2,710,204 | A | 6/1955 | Faith-Ell |
| 2,974,347 | A | 3/1961 | Seyfried |
| 3,159,412 | A | 12/1964 | Descarries |
| 3,203,023 | A | 8/1965 | Jepson et al. |
| 3,245,698 | A | 4/1966 | Fromknecht |
| 3,351,359 | A | 11/1967 | Ferraris |
| 3,354,496 | A | 11/1967 | Jonsson |
| 3,512,207 | A | 5/1970 | Ettridge |

(Continued)

FOREIGN PATENT DOCUMENTS

| | | | |
|---|---|---|---|
| DE | 2052606 | A1 | 5/1972 |
| DE | 3904395 | A1 | 8/1990 |

(Continued)

OTHER PUBLICATIONS

Hoover Powered Nozzle Tilt image, Jan. 1980, www.fiorijanitorial.com.

(Continued)

*Primary Examiner* — David Redding
(74) *Attorney, Agent, or Firm* — Kolisch Hartwell, P.C.

(57) ABSTRACT

A suction nozzle has a housing, a tilting bearing, a connection nozzle, a lock for the tilting bearing, a connection nozzle, a lock for the tilting bearing, actuators and a housing duct. The tilting joint has a bearing connected rigidly to the housing and a connector piece which is pivotally mounted about an axis S. The lock has a first locking element, which is mounted rotatably on the housing, and a second locking element, which is rigidly connected to the connecting piece of the tilting joint. A restoring force for the first locking element is generated by magnets.

13 Claims, 14 Drawing Sheets

(56) References Cited

U.S. PATENT DOCUMENTS

| | | | |
|---|---|---|---|
| 3,553,629 | A | 1/1971 | Brown et al. |
| 3,565,464 | A | 2/1971 | Wolf |
| 3,633,942 | A | 1/1972 | Meyerhoefer |
| 3,932,912 | A | 1/1976 | Johnson |
| 3,962,745 | A | 6/1976 | Collier |
| 4,422,702 | A | 12/1983 | Nordeen |
| 4,423,534 | A | 1/1984 | Lyman et al. |
| 4,521,936 | A | 6/1985 | Medwed |
| 4,537,424 | A | 8/1985 | Maier et al. |
| 4,549,328 | A | 10/1985 | Martin et al. |
| 4,696,076 | A | 9/1987 | Ahlf et al. |
| 4,700,429 | A | 10/1987 | Martin et al. |
| 4,940,415 | A | 7/1990 | Westergren |
| 4,980,945 | A | 1/1991 | Bewley |
| 5,075,921 | A | 12/1991 | Gleadall |
| 5,109,568 | A | 5/1992 | Rohn et al. |
| 5,331,715 | A | 7/1994 | Johnson et al. |
| 5,389,004 | A | 2/1995 | Gray et al. |
| 5,472,346 | A | 12/1995 | Gray et al. |
| 5,537,710 | A | 7/1996 | Selewski et al. |
| 5,551,731 | A | 9/1996 | Gray et al. |
| 5,584,095 | A | 12/1996 | Redding et al. |
| 6,006,401 | A | 12/1999 | Jailor et al. |
| 6,065,183 | A | 5/2000 | Hammeken et al. |
| 6,345,408 | B1 | 2/2002 | Nagai et al. |
| 6,532,622 | B2 | 3/2003 | Seon et al. |
| 6,536,076 | B2 | 3/2003 | Scian et al. |
| 6,581,974 | B1 | 6/2003 | Ragner et al. |
| 6,823,559 | B2 | 11/2004 | Kaffenberger et al. |
| 7,290,308 | B2 | 11/2007 | Downey et al. |
| 8,060,980 | B2 * | 11/2011 | Mayes et al. ..... 15/410 |
| 2001/0027586 | A1 | 10/2001 | Lee |
| 2001/0037536 | A1 | 11/2001 | Kim |
| 2001/0042285 | A1 | 11/2001 | Seon et al. |
| 2003/0145422 | A1 | 8/2003 | Kaffenberger et al. |
| 2006/0207054 | A1 | 9/2006 | Loebig |

FOREIGN PATENT DOCUMENTS

| | | | |
|---|---|---|---|
| DE | 4004006 | A1 | 8/1991 |
| DE | 29611160 | U1 | 8/1996 |
| DE | 10201961 | A1 | 8/2003 |
| DE | 10201961 | B4 | 4/2006 |
| EP | 0338513 | A2 | 10/1989 |
| EP | 0433609 | A1 | 6/1991 |
| EP | 0338513 | A3 | 7/1991 |
| EP | 0433609 | B1 | 7/1993 |
| EP | 338513 | B1 | 7/1994 |
| EP | 1110496 | A1 | 6/2001 |
| EP | 1155652 | A1 | 11/2001 |
| EP | 1214902 | A2 | 6/2002 |
| EP | 1110496 | B1 | 7/2003 |
| EP | 1214902 | A3 | 12/2004 |
| EP | 1214902 | B1 | 6/2006 |
| GB | 477025 | A | 12/1937 |
| GB | 598972 | A | 3/1948 |
| GB | 2115273 | A | 9/1983 |
| GB | 2140673 | A | 12/1984 |
| GB | 2216178 | A | 10/1989 |
| GB | 2216178 | B | 4/1992 |
| GB | 2342120 | A | 4/2000 |
| GB | 2346076 | A | 8/2000 |
| GB | 2342120 | B | 2/2001 |
| GB | 2346076 | B | 1/2003 |
| JP | 10328098 | A | 12/1998 |
| JP | 11056720 | A | 3/1999 |
| JP | 11313788 | A | 11/1999 |
| WO | 9713445 | A1 | 4/1997 |
| WO | 2004014211 | A1 | 2/2004 |

OTHER PUBLICATIONS

"Vacuum Cleaners", article in Consumer Reports, 1993, pp. 312-314, Consumers Union of United States, Inc.

"Vacuum Cleaners", article in Home Care, 1996, pp. 117-121, EBSCO Publishing.

"Ratings and Recommendations—Vacuum Cleaners", article in Consumer Reports, Mar. 1996, pp. 30-35, Consumers Union of United States, Inc.

"Dealing with the Dirt", article in Consumer Reports, Jan. 1997, pp. 34-36, Consumers Union of United States, Inc.

"Rating and Recommendations: Vacuum Cleaners", article in Consumer Reports, 1997, pp. 132-136, Consumers Union of United States, Inc.

"Small Appliances—Vacuum Cleaners", article in Consumer Reports Buying Guide, 1997, pp. 121-125, Consumers Union of United States, Inc.

Hoover Powered Nozzle exploded parts diagram Tilt Lock Mechanism, 1999, www.fiorijanitorial.com.

Hoover WindTunnel Canister Cleaner with Powered Nozzle—Owner's Manual, 1999, pp. 1-12, The Hoover Company.

Rubinstein, Ed "Operators tap different vacuuming solutions to cleanup", article from Nation's Restaurant News, Apr. 12, 1999, pp. 18-19, vol. 33 Issue 15.

"Vac Attack—CR Dishes the Dirt on Vacuum Cleaners", article from Consumer Reports, Jul. 1999, pp. 42-47, Consumers Union of United States, Inc.

Bissell User's Guide Model 6700, 2000, 10 pages, Bissell, Inc.

Dirt Devil Owner's Manual—Operating and Servicing Instructions, 2000, 8 pages, Royal Appliance Mtg. Co.

Hoover WindTunnel Canister Cleaner with Powered Hand Tool Owner's Manual, 2000, 14 pages, The Hoover Company.

"Coming Clean on Vacs" article from Consumer Reports, May 2000, pp. 27-32, Consumers Union of United States, Inc.

"Total Package: For vacuum water basin, DuraStar polymer by Eastman fill Rexair's three needs", Appliance Manufacturer Magazine, Aug. 2000, p. 36.

Dirt Devil Manual for Power Pak Models, Dec. 2000, 1 page.

"Clean Sweep" article from Good Housekeeping, Mar. 2001, vol. 232 Issue 3, pp. 49-50.

"Product Updates: Vacuum Cleaners" article from Consumer Reports, Aug. 2001, pp. 46-47, Consumers Union of United States, Inc.

"Philips rolls out vacuum cleaner range" article from Marketing Week, Sep. 27, 2001, p. 8.

Wolf, Alan "Floor Care Vendors Focus on Product Innovation" article from Major Appliances, Nov. 5, 2001, p. 43.

"Product Review—Building Maintenance" American City and Country, Dec. 2001, p. 4, Primedia Business Magazine & Media, Inc.

"Nooks and Crannies" article from Appliance Manufacturer Magazine, Dec. 2001, p. 10.

Wolf, Alan "Sweeping Changes in Store for Floor Care Products" article from Major Appliances, Jan. 8, 2002, p. 129.

"Clearing the air—Vacuum cleaners" article from Consumer Reports, Feb. 2002, pp. 42-45.

Wolf, Alan "Vacuum Cleaner Sales Flat in 2001" article in Major Appliances, Feb. 25, 2002, p. 51.

Filippi, Gianni "Sensing Pressure in Vacuums: Adaptive, intelligent control made possible with pressure sensors" Applicance Manufacturer Magazine, Jan. 2002, pp. 23-24.

Wolf, Alan "BSH Expands Domestic Production, Enters Floor Care" article from Major Appliances, Mar. 11, 2002.

"Equipment News" article from Restaurant Hospitality, May 2002, p. 110.

Greenwald, John "Vacuuming up the U.S. Floor-Cleaning Market" article from Business News, 2002, 2 pages.

Numatic Turbo Electric Vacuum Tilt Swivel Lock images (6), 2002.

Meyer, Tedra "Vacuum Vendors Innovate for Form, Function" Major Appliances, Aug. 19, 2002, p. 34.

"Wet/Dry Vacuums" Consumer Reports, 2002, pp. 114-116, Consumer Union of United States, Inc.

Numatic International Spare Parts, Model No. Turbo Electric (MK 2) (KIT-T20/KIT-T22) parts list, Aug. 22, 2003, 2 pages.

ProTeam, Wessel Werk Electric Power Nozzle Operating Manual, Dec. 2009, 16 pages.

Bosch, BSG813 UC Vacuum Cleaner Use and Care Manual, date unknown, 57 pages, BSH Home Appliances Corporations.

* cited by examiner

VACUUM CLEANER NOZZLE WITH MAGNETIC LOCK

CROSS-REFERENCE TO RELATED APPLICATION

This application claims priority to German Patent Application No. 10 2010 038 026.1, filed Oct. 6, 2010, which is hereby incorporated by reference.

BACKGROUND

The general operation of vacuum cleaners is known. A vacuum cleaner has a suction mechanism, which sucks in the air. The suction mechanism is connected to a suction pipe via a hose. The suction pipe is connected to a suction head, which has a construction suitable for the intended use.

When flat surfaces are being cleaned, active, electronic suction heads are used in addition to passive nozzles. These have electrically powered brushes, which, cooperating with the suction, improve the cleaning effect of the vacuum cleaner.

In addition, the user needs to be able to handle the vacuum cleaner easily. Thus, it is desirable for the vacuum cleaner to be placed in a parking position or stowed compactly when not being used. To this end, provision can be made for connecting the components such as a suction mechanism, a hose and/or a suction nozzle in a specific arrangement.

Releasing these connections or locks can prove inconvenient, however, as they often jam or require substantial effort to separate the components. Similar considerations apply, for example, to locks that lock the connection nozzle for the hose in a certain position.

SUMMARY

The present application relates to a suction head for a vacuum cleaner.

In some embodiments, the suction head for the vacuum cleaner comprises: a housing with a base unit and with a cover element that can be arranged at the base unit; a tilting joint for connecting a connection nozzle to the housing with a bearing arranged at the housing and a connector piece which is mounted in the bearing and is pivotable about a pivot axis; a locking mechanism for locking the connector piece in a predetermined angular position against pivoting relative to the housing; wherein the locking mechanism has a first locking element which is movably connected to the housing, and a second locking element which is connected to the connector piece of the tilting joint, wherein the first locking element is configured for mutual engagement with the second locking element, when the connector piece of the tilting joint is aligned in the predetermined angular position and the first locking element is arranged in a first engagement position at the housing; and an actuator for releasing the lock by pressing the actuator.

Proceeding therefrom, an object of the present disclosure is to provide a suction head for a vacuum cleaner with which it is possible to place the vacuum cleaner in a desired parking position and to release it therefrom simply and without much effort.

This object is achieved by providing a suction head for a vacuum cleaner as per claim 1. Other advantageous embodiments of the disclosure will become apparent from the characteristics of the dependent claims.

In some embodiments, a suction head for a vacuum cleaner comprises: a housing with a base unit and with a cover element that can be arranged at the base unit; a tilting joint for connecting a connection nozzle to the housing with a bearing arranged at the housing and a connector piece which is mounted in the bearing and is pivotable about a pivot axis; a locking mechanism for locking the connector piece in a predetermined angular position against pivoting relative to the housing; wherein the locking mechanism has a first locking element which is movably connected to the housing, and a second locking element which is connected to the connector piece of the tilting joint, wherein the first locking element is configured for mutual engagement with the second locking element, when the connector piece of the tilting joint is aligned in the predetermined angular position and the first locking element is arranged in a first engagement position at the housing; an actuator for releasing the lock by pressing the actuator. The first locking element may be moved by actuation of the actuator from the first engaged position into at least a second unlocked position to release the mutual engagement with the second locking element; the locking mechanism has a restoring mechanism, which moves the first locking element back into the engaged position after actuation of the actuator is complete; and the restoring mechanism has at least one magnet arrangement for exerting the restoring force from the unlocked position towards the engaged position.

The suction nozzle can for example be an active nozzle with a rotatable and electrically powered brush roller. The housing has an opening in the bottom part through which the dirt particles are sucked into the housing. From there, they travel through a housing duct into the tilting joint. A connection nozzle is usually connected to this. The tilting joint has a joint duct, which, at least in the working direction of the connecting pipe, creates a connection between the housing duct and the connection nozzle for the suction pipe.

The tilting joint permits practical handling during use because the inclination of the handle (suction pipe) can be changed during use as needed and depending on the user. A connection nozzle, perhaps rotatable, is usually connected to the tilting joint. The suction pipe is connected to said nozzle. By virtue of being locked when not in use, i.e., in a parking position, the suction pipe can be held in an upright parking position. The magnetic restoring mechanism provides secure locking which can easily be released, however.

The magnetic restoring force renders actuation for the purpose of releasing the lock especially easy and convenient. The restoring force of a magnet has a $1/r^2$ characteristic. This means that, after the initial actuation of the actuator, the requisite force decreases relatively quickly when the magnets in the magnet arrangement move apart relative to one another. In contrast, elastic engagements often require very large forces to release the suction pipe from the lock relative to the suction nozzle. Where a return force is generated by an elastic spring, the force is relatively constant over the operating range of the actuator, i.e. the force required to release the lock can, relative to the initial actuation force, decrease to a lesser extent over the operating range.

This characteristic ensures secure locking, which is easily released however. The actuator transmits an actuating movement to the first locking element. This in turn separates two magnets (permanent magnets, for example) from one another. The requisite force decreases relatively rapidly, at a rate of $1/r^2$, with the actuating movement or the extent of actuation. Jamming is also excluded.

Preferably in some embodiments, the first locking element is arranged rotatably at the housing about a rotary shaft relative to the housing.

The rotary shaft is especially aligned parallel with the pivot axis of the tilting joint. This is particularly advantageous in that embodiment in which actuation of the actuator proceeds perpendicularly to the pivot axis, for example from above. The actuator can be a foot switch (or, especially preferred in some embodiments, as they are suitable for left-footed and right-footed people: two foot switches on both sides of the connection nozzle). Another alignment is possible if other actuators are provided, for example, manually operated buttons.

The first locking element can have at least a first engagement element and/or the second locking element can have at least one second engagement element for engagement with the other corresponding locking element. The engagement elements may be hooks, protrusions or corresponding recesses. At any rate, the complementary engagement elements permit locking if the first engagement element is in the locking or engagement position. In this position, the magnetic restoring force acts in the direction of the engaged position. Actuation of the actuator counteracts the restoring force and brings the first engagement element out of the engaged position into an unlocked position. In this position, the connection nozzle can be freely pivoted out of the parking position.

The magnet arrangement can especially have a first magnet that is arranged on the housing or firmly/rigidly connected to it.

The first locking element can, in some embodiments of the disclosure, be formed as a rocker, which has a rotary shaft which is arranged rotatably at the housing. The rotary shaft or shaft is rotatably mounted in the housing and coupled to the actuator or actuators via at least one connecting arm.

The first locking element has especially a magnetic holder for holding a second magnet of the magnet arrangement. It is also possible for several first and/or second magnets or magnetic mounts to be provided, depending on which magnetic forces are needed. The magnetic holder extends away from the rotary shaft, such that the magnet can exert a torque on the first locking element. The distance from the rotary shaft depends on the requisite torque and can be determined by considering the leverage on the rotary shaft.

The first locking element can have at least one connecting arm, which produces a movable connection or coupling between the first engagement element and the actuator. The length of the arm, which can exert a torque on the rotary shaft, is also determined on the basis of the laws of levers.

The first engagement element extends in particular from the rotary shaft in a first direction, the magnetic holder from the rotary shaft in a second direction, and the connecting arm from the rotary shaft in a third direction. The directions may be identical or different. For structural reasons, the second direction is approximately opposite in direction to the first and third.

The suction head preferably has a connector for connecting a suction pipe, which is coupled to the connector piece, and whose connection area for the suction pipe is rotatable relative to the connector piece of the tilting joint, wherein the locking mechanism has a third locking element for locking the connecting area of the connection nozzle in a predetermined angular position against rotation relative to the tilting joint. The axis of rotation is generally perpendicular on the pivot axis of the tilting joint or is arranged perpendicular thereto. Due to the rotation movement, the suction nozzle, as a result of a slight curvature of the connection nozzle, can be laterally twisted (with respect to the longitudinal axis/main movement direction of the nozzle). The rotation can optionally also be blocked in the parking position, particularly when the nozzle is in a predetermined angular position with respect to the connecting piece of the bearing.

The third locking element can optionally have a third engagement element arranged at the housing for the purpose of engagement with a complementary engagement element provided at the connection nozzle.

Protection is sought for all the aforementioned characteristics and those described in the following description of characteristics, in any combination thereof, even if certain combinations are not to be found in the claims.

DETAILED DESCRIPTION

Figure 1:
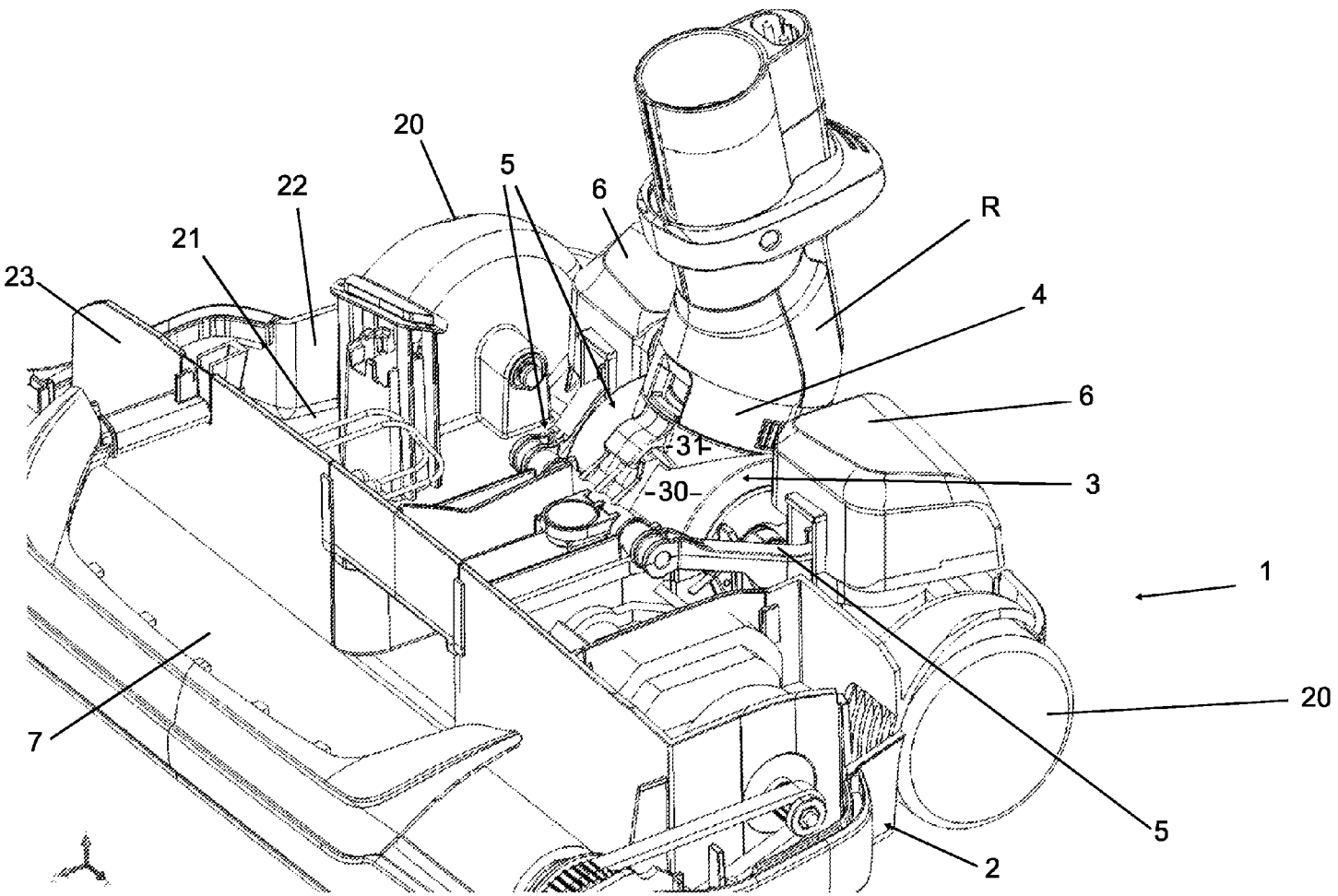
FIGS. 1-4 illustrate a first embodiment of a suction nozzle in different views or sections.

FIG. 1 shows a first embodiment of a first suction nozzle 1. This has a housing 2, a tilting bearing 3, a connection nozzle 4, a lock 5 for the tilting bearing 3, actuators 6 and a housing duct 7.

The suction nozzle 1 is shown in this diagram without a cover part, which also belongs to the housing 2. Rollers 20 are arranged at both sides of the housing 2. The housing 2 also comprises a bottom part 21, side panels 22 and internal dividers 23. Furthermore, slots can be provided, to which specific components can be attached or between which specific components can be inserted.

The tilting joint 3 has a bearing 30 connected rigidly to the housing 2 and a connector piece 31 which is pivotally mounted about an axis S. Attached to the connector piece 31 is a tilting nozzle 4, in particular so as to be rotatable about an axis of rotation R, which is perpendicular to the pivot axis S.

Figure 2:
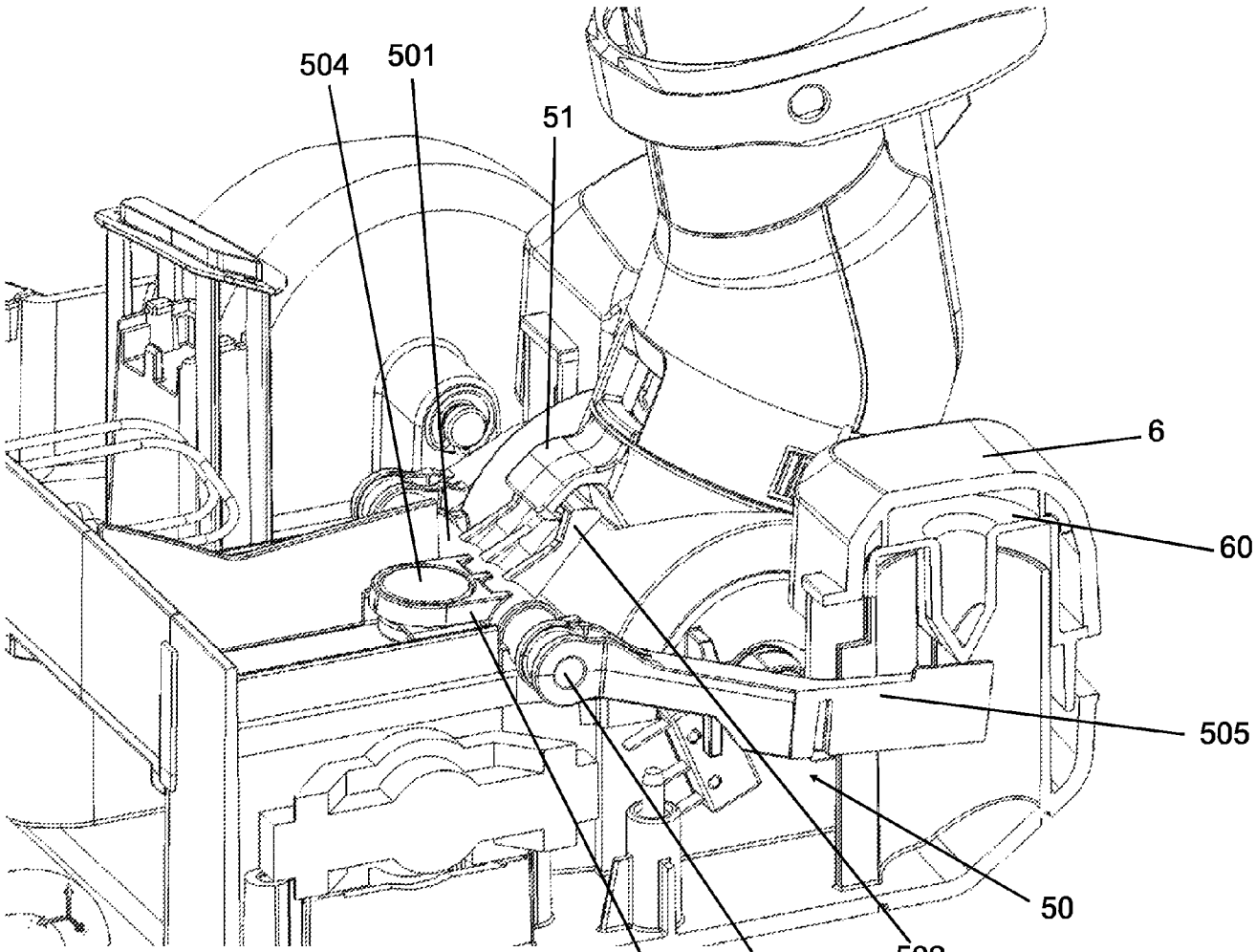
Figure 3:
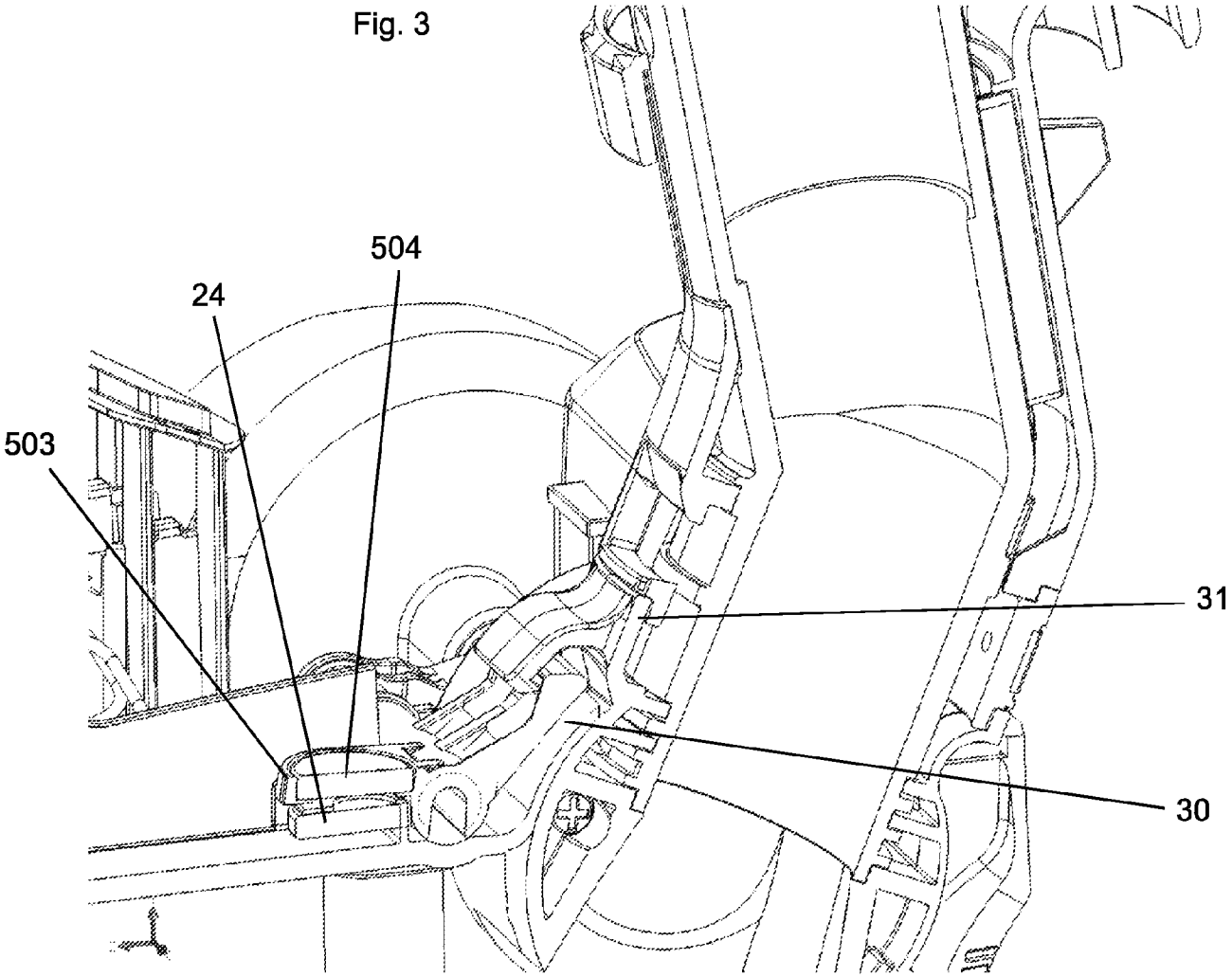

A locking mechanism 5 (see FIG. 1), as shown in detail in FIG. 2, has a first locking element 50, which is rotatably mounted at the housing, and a second locking element 51, which is rigidly connected to the connector piece of the tilting joint 31 (see FIG. 3).

The first locking element 50 is formed as a rocker, which has a rotary shaft 501 which is rotatable about an axis D, an engagement hook 502 which extends from the rotary shaft 501, and a magnetic holder 503, which also extends from the rotary shaft 501. In the magnetic holder 503 is arranged a first magnet 504. In addition, two connecting arms 505 are provided, which extend from both ends of the rotary shaft 501 to an actuator 6, for example a foot switch, and which are coupled to it by an interior part of the switch which attacks the top of the connecting arm 505 and, when switch 6 is pressed down, pushes said arm downwards. Thus, the rocker is rotated about the axis D.

The second locking element 51 comprises essentially an engagement hook extending from the second connector piece 31. In the illustration in FIG. 2, the two engagement elements 502 and 51 are in mutual engagement. The first locking element 50 is in a locking or engaged position.

In FIG. 3, the lock is shown again. It is clear in this regard that the first magnet 504 accommodated in the magnetic holder 503 cooperates with a second magnet 24 which is firmly connected to the bottom part 21, i.e., the magnets 504 and 24, which can be permanent magnets, attract each other. As a result, the rocker will remain in the locked position in the absence of external influences.

Figure 4:
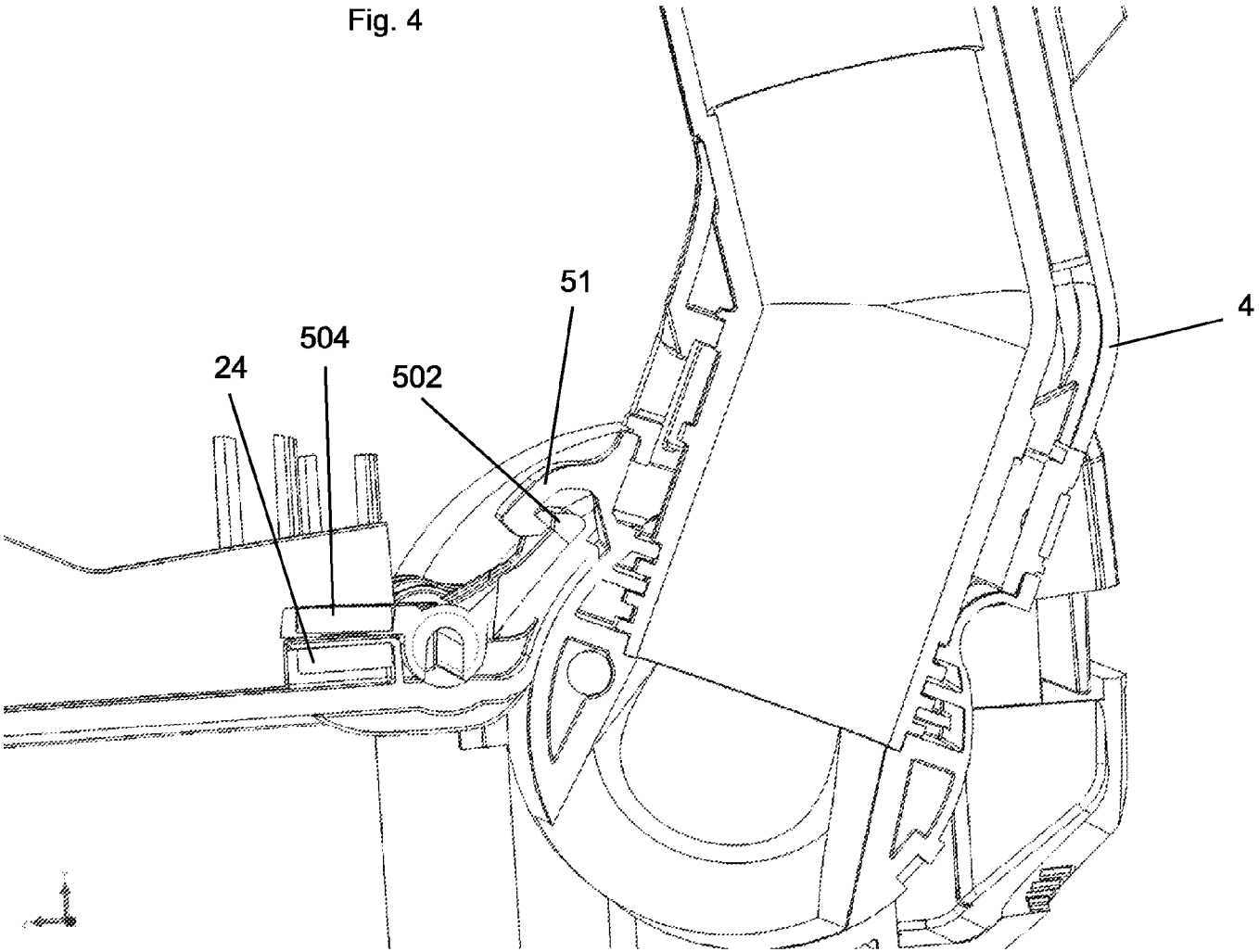

FIG. 4, too, shows this clearly. The connection nozzle 4 is thus securely held in a parking position in an essentially vertical orientation.

Figure 5:
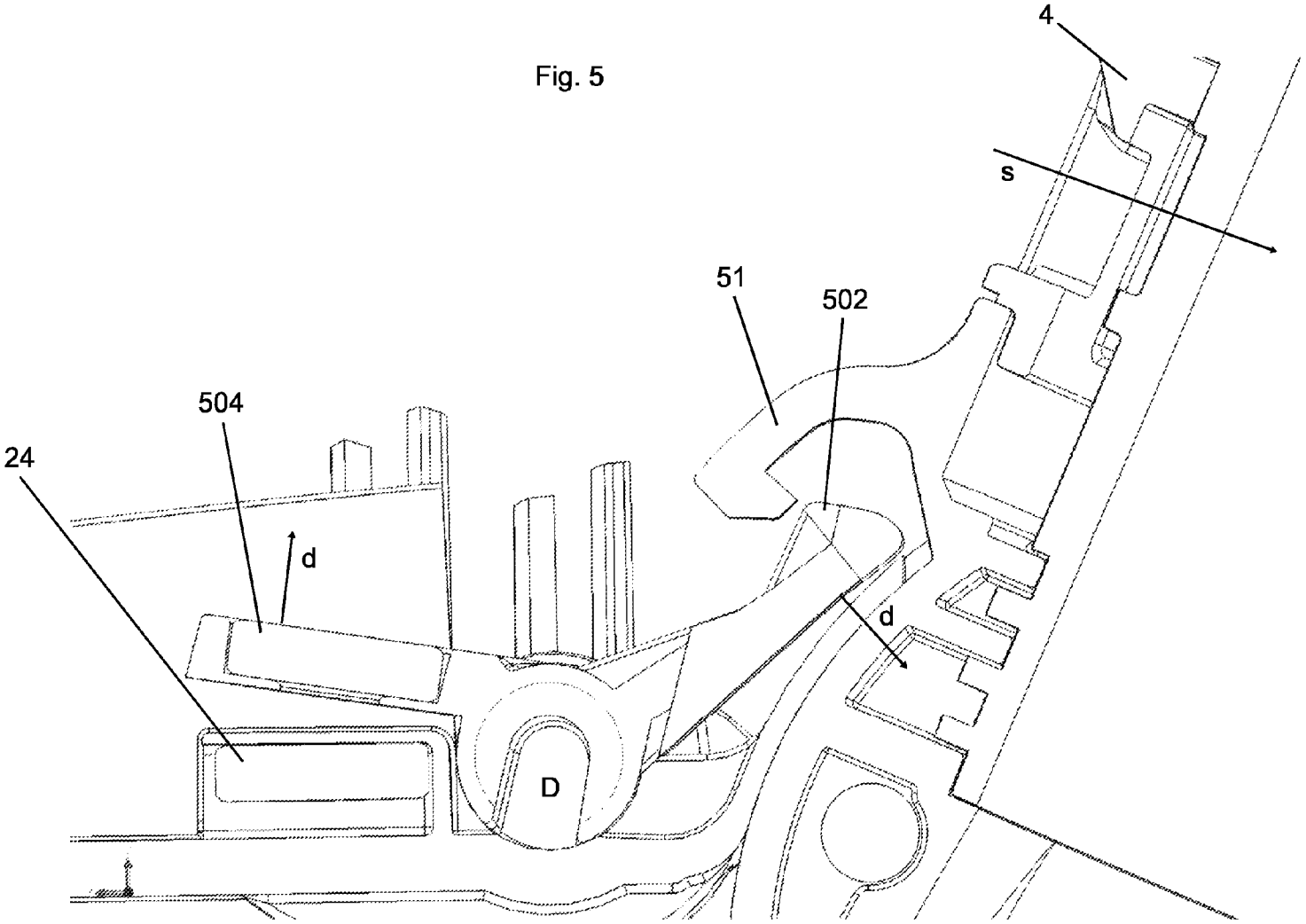
FIGS. 5-8 Illustrate the first embodiment during the unlocking and locking of the locking mechanism.

FIG. 5, now, shows a situation in which the actuating switch 6 has been pressed down. Consequently, the connecting arm 505 has been moved downwards, as a result of which the rocker as a whole, has been rotated against the attractive force of the magnets 504 and 24 about the rotary shaft D by a distance d, which is indicated by arrows. Accordingly, the hook 502 of the first locking element 50 has been brought into an unlocked position, disengaged from the second locking element 50. As indicated by the arrow s, the nozzle 4 can thus be pivoted into a working position.

Figure 6:
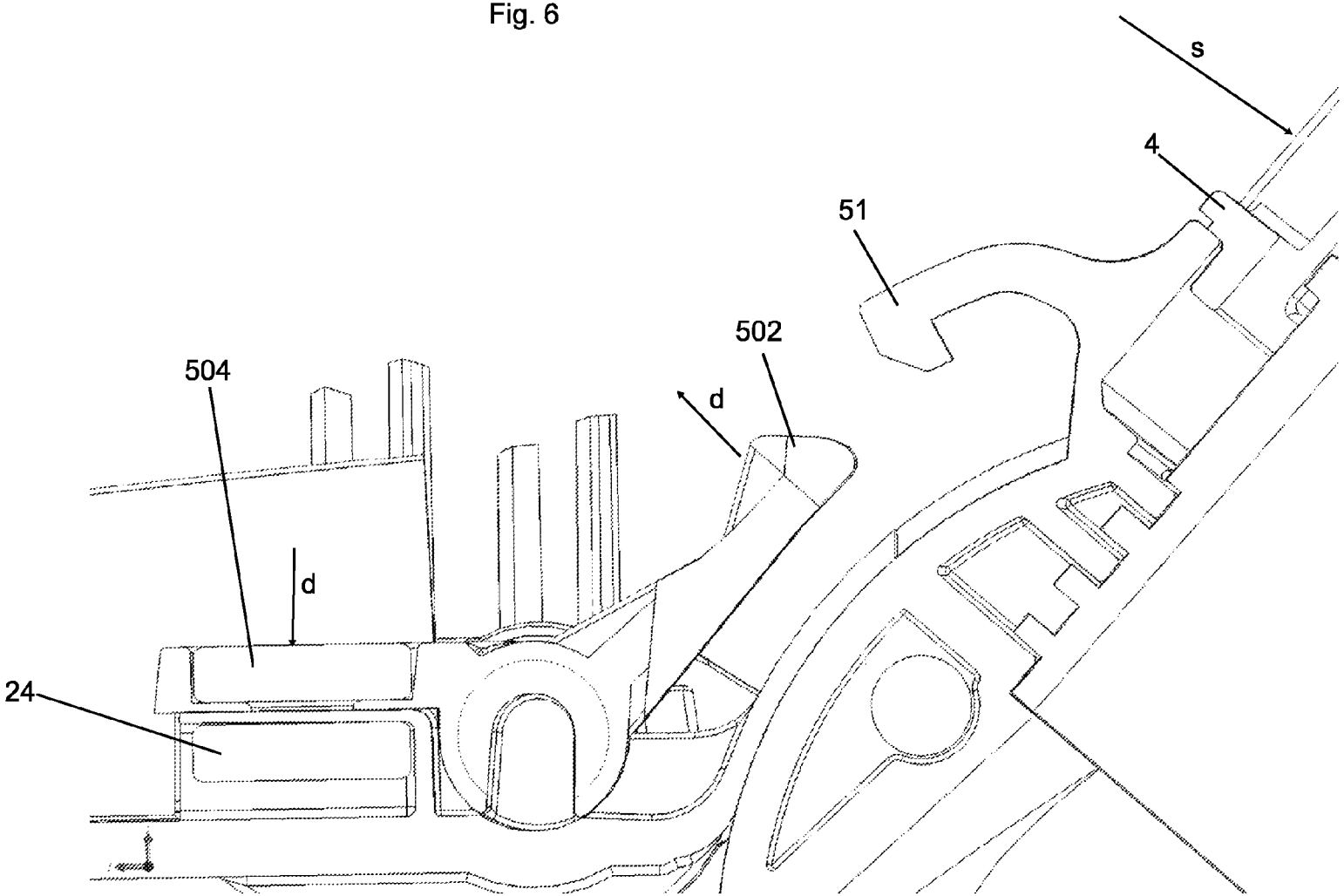

This is illustrated in FIG. 6. After the pivoting s, actuating switch 6 can be released, wherein the magnets 24, 504 attract each other, and the rocker is moved through distance d into the engagement position about the axis D. However, now the hook 502 is not in engagement with the hook 51.

Figure 7:
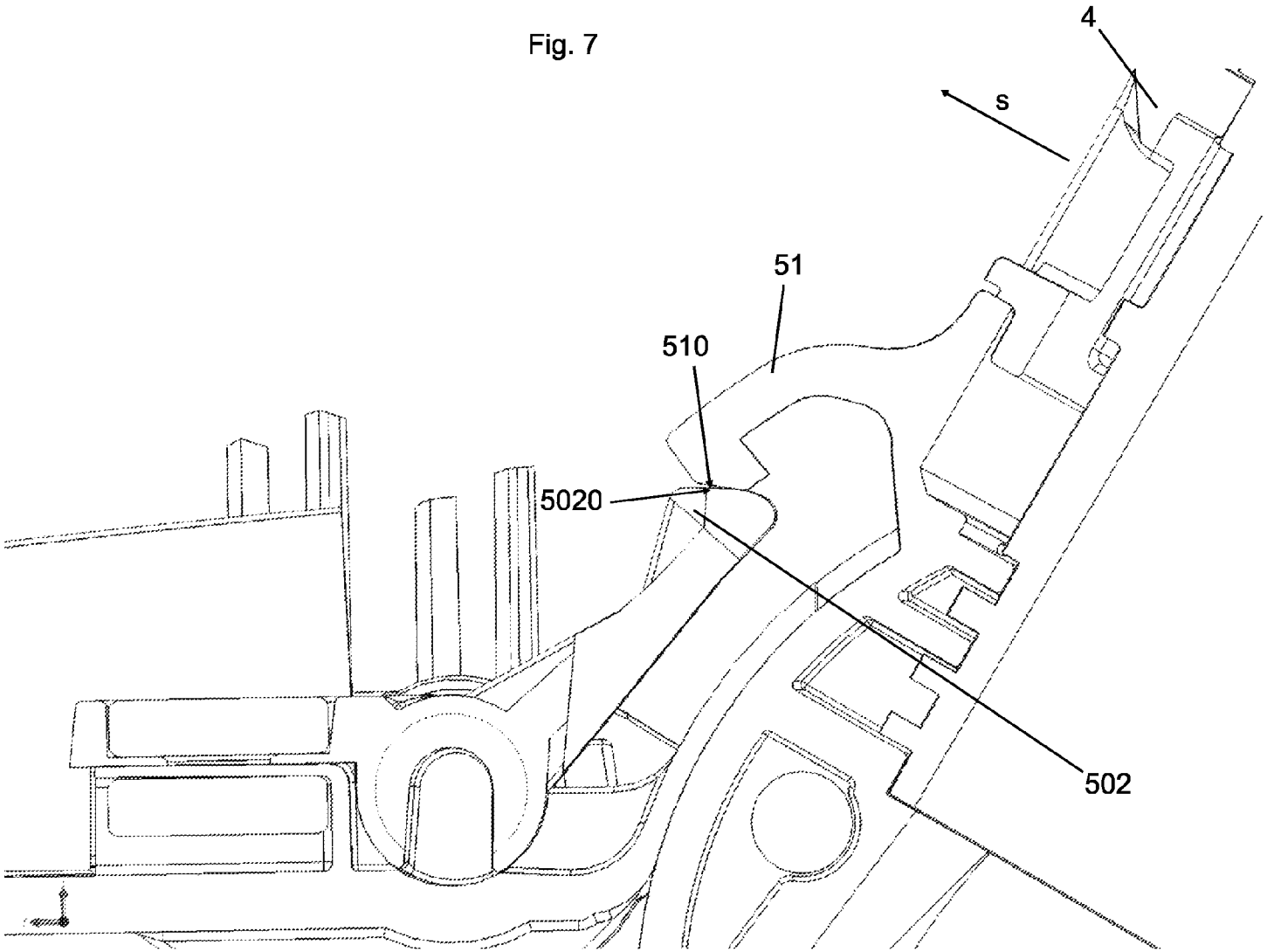
Figure 8:
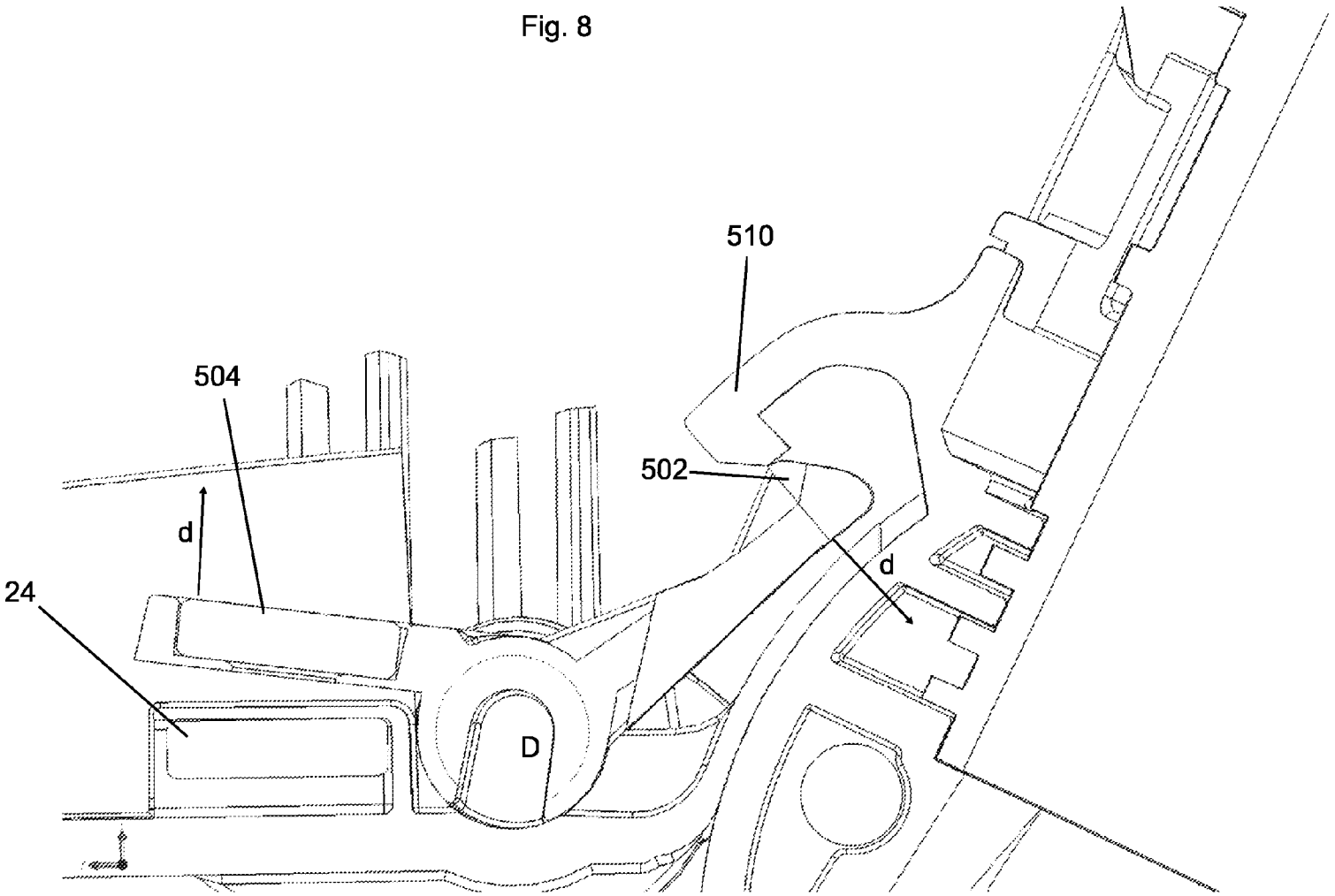

As the nozzle 4 pivots back (see arrow s) into the parking position (locking position, FIG. 7), a first sliding surface 5020 of the first locking element 50 and a sliding surface 510 of the second locking element 51 meet and come into contact with each other. The movement s of the nozzle ensures that the second locking element 51 rotates the first locking element 50, as shown in FIG. 8, against the magnetic force between 24 and 504 in the direction of the arrows d, wherein the sliding surfaces 5020 and 510 slide over each other until the second hook 510 has slid over the first hook 502 and the arrangement has returned to the parking position as per FIGS. 1 to 4.

Figure 9:
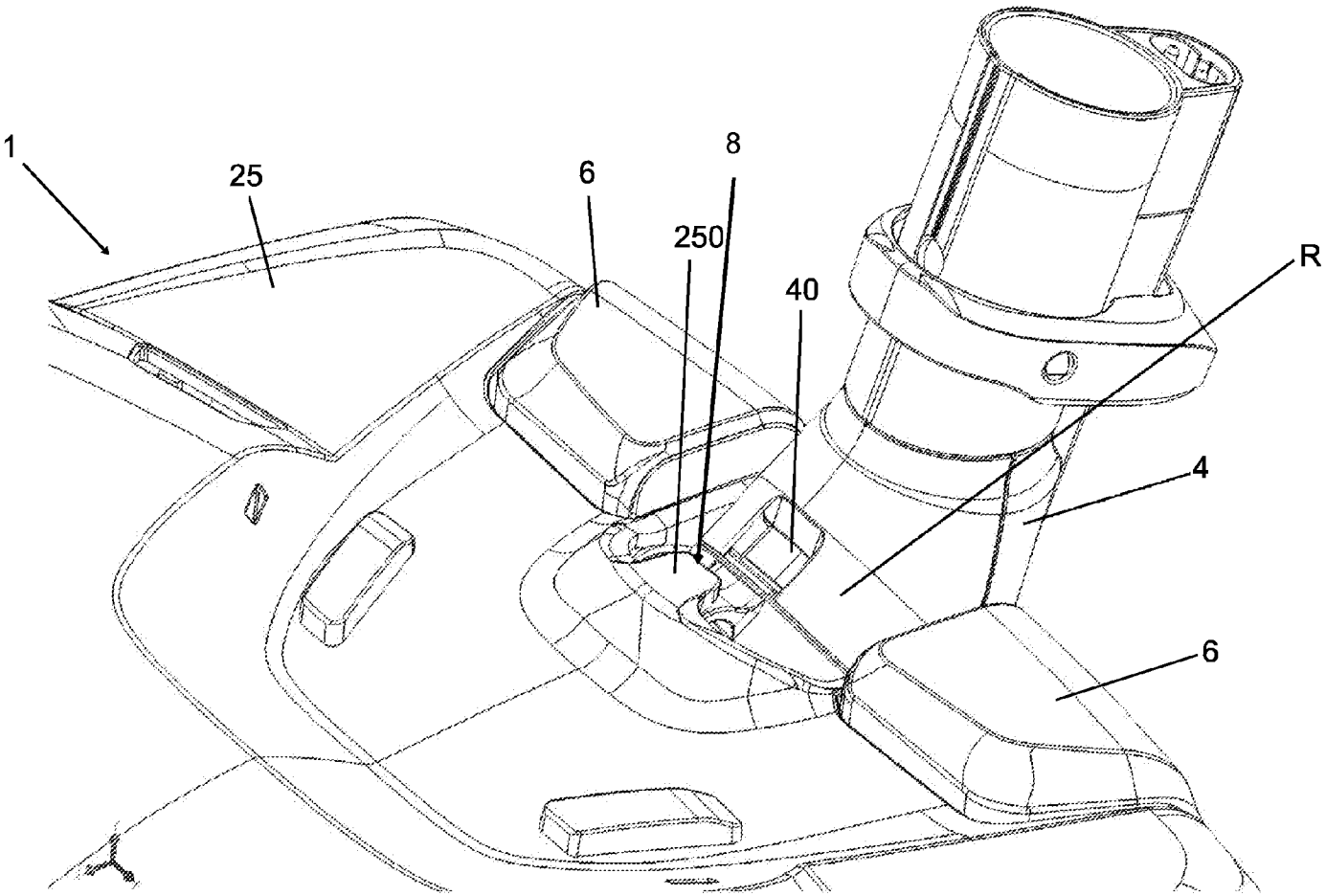
FIGS. 9-11 illustrate the first embodiment of the suction nozzle with a cover part.
Figure 10:
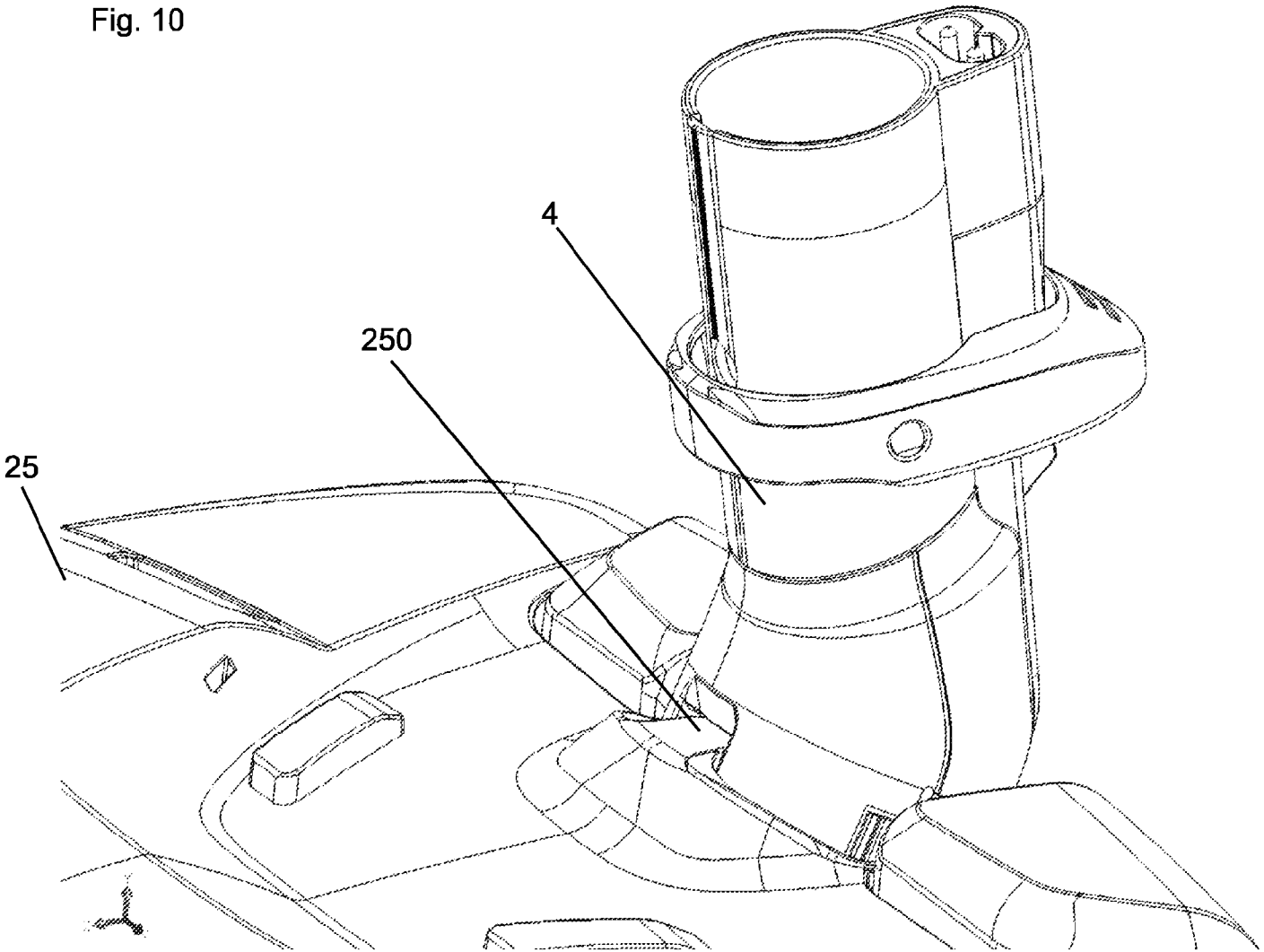

FIG. 9 shows the suction nozzle 1 with a cover part 25 arranged on the housing base 21, 22, 23. The cover part 25 has a rear recess for the connection nozzle 4. The illustration also shows a further locking mechanism 8, which prevents rotation of the connection nozzle 4 in the upright parking position (compare FIGS. 1 to 4) of the connection nozzle 4. The further locking mechanism 8 has a protrusion 250 extending from the housing cover 25 into the rear recess. The rotatable nozzle 4 has a complementary opening or recess 40 into which the protrusion 250 engages, when, as shown in FIG. 10, the nozzle ("bone") has been brought into the upright parking position (locking position for pivoting). The protrusion 250 projecting into the opening 40 prevents rotation of the nozzle 4 with respect to the housing 2.

Figure 11:
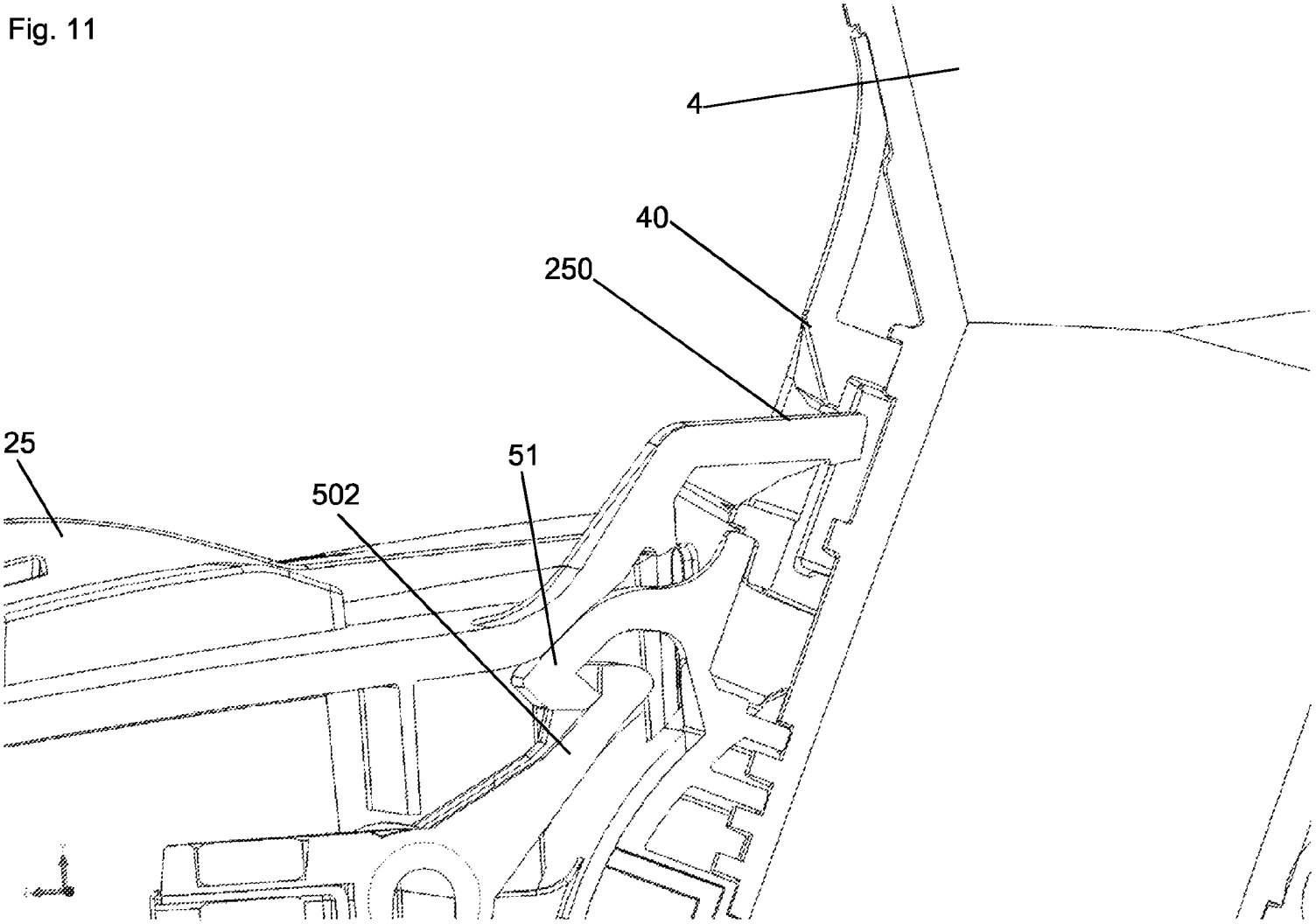

FIG. 11 shows the situation in a cross-sectional view. Both the pivot locking elements 50, 51, and the rotation locking elements 250, 40 are in mutual engagement and thus simultaneously prevent pivoting and rotation of the nozzle 4.

Figure 12:
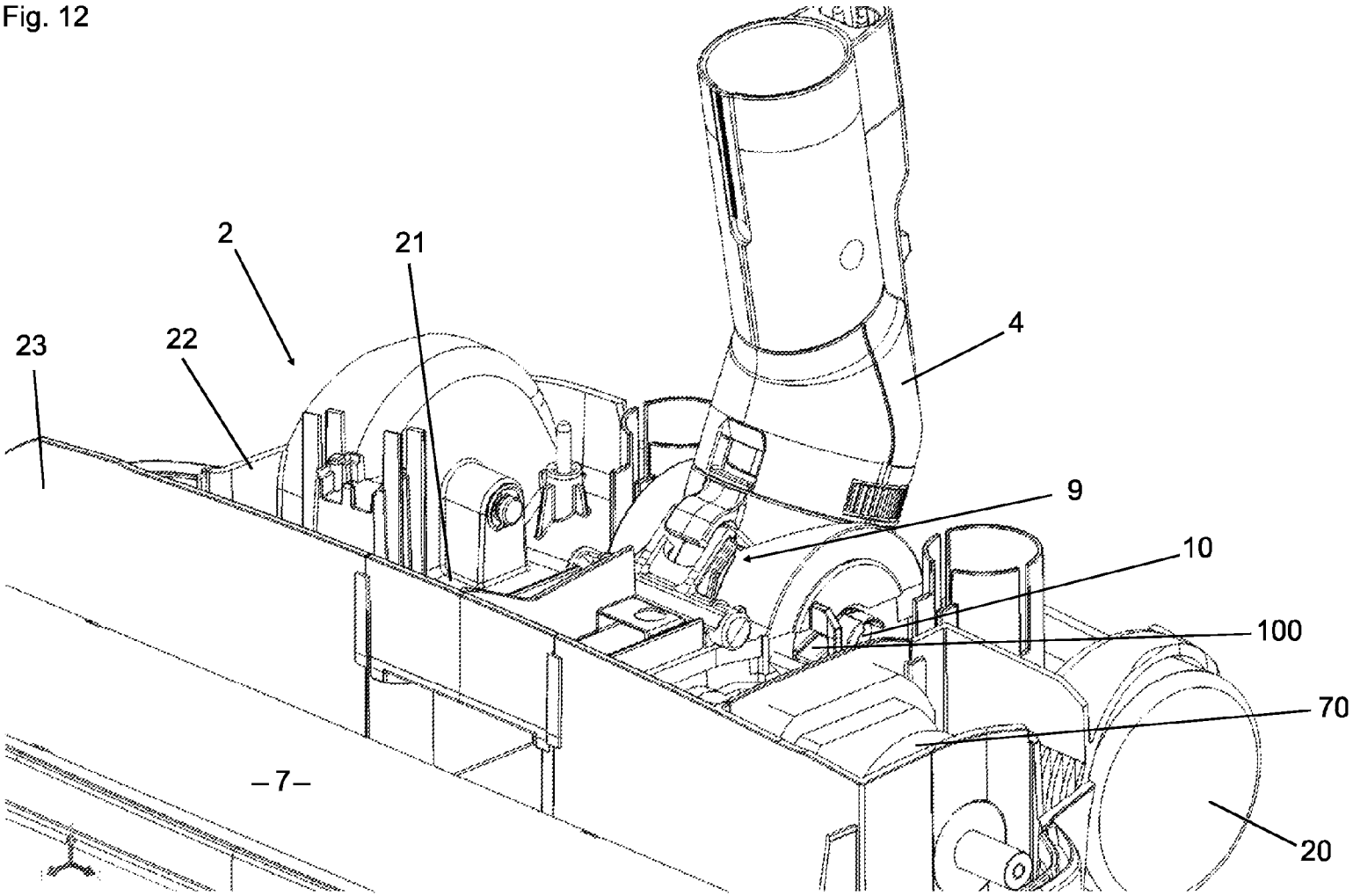
FIGS. 12-14 illustrate another embodiment of a suction nozzle in different views.

Another embodiment of the disclosure is shown in FIG. 12. This embodiment differs from the first embodiment only in the nature of the pivot lock, which is therefore labeled with the reference numeral 9 instead of the reference numeral 5. The other components with the same reference numerals as in the first embodiment correspond to those found in the first embodiment and are not described in detail. In FIG. 12, the pivot lock is locked 9, since the nozzle 4 is in a parking position.

Also shown is an element which is also present in the first embodiment, namely a gate 10, which activates a switch 100 when the nozzle 4 is in the parking position. Thus, the gate 10 activates the switch such that all the electrical components of the suction nozzle, such as the motor 70 of the brush drive, are deactivated.

Figure 13:
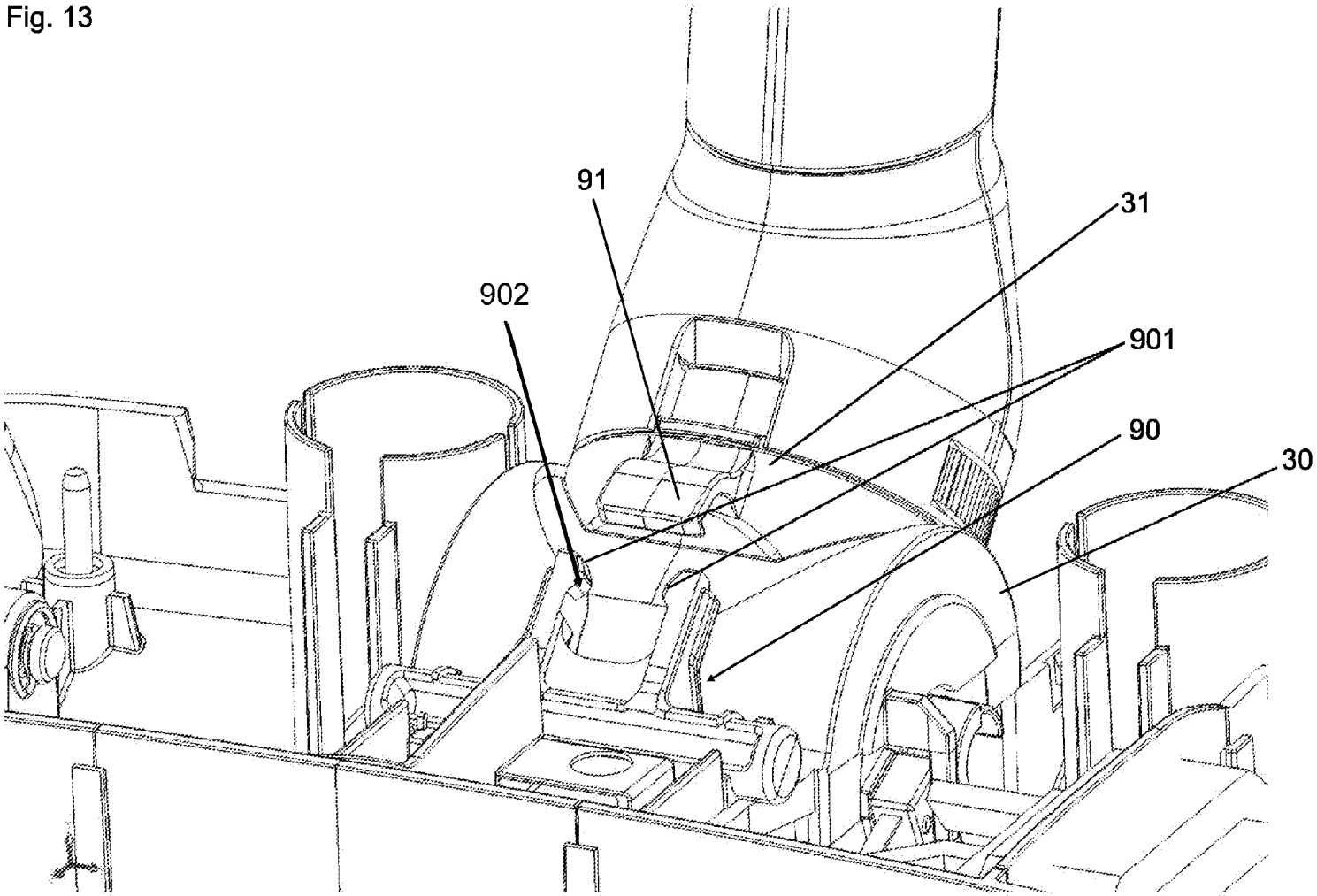

The locking mechanism 9 has a fixed locking shaft 90 (see FIG. 13), which is essentially rigidly connected to the housing 2. The locking shaft 90 has a fork-like engagement part with inwardly projecting hooks 901 on both sides. These are elastically formed and can be pushed apart.

In addition, the locking mechanism 9 comprises a second engagement element 91 firmly connected to the connector piece 31 of the bearing 3, said engagement element essentially configured as a hook (rotating parts with hook moulding).

Figure 14:
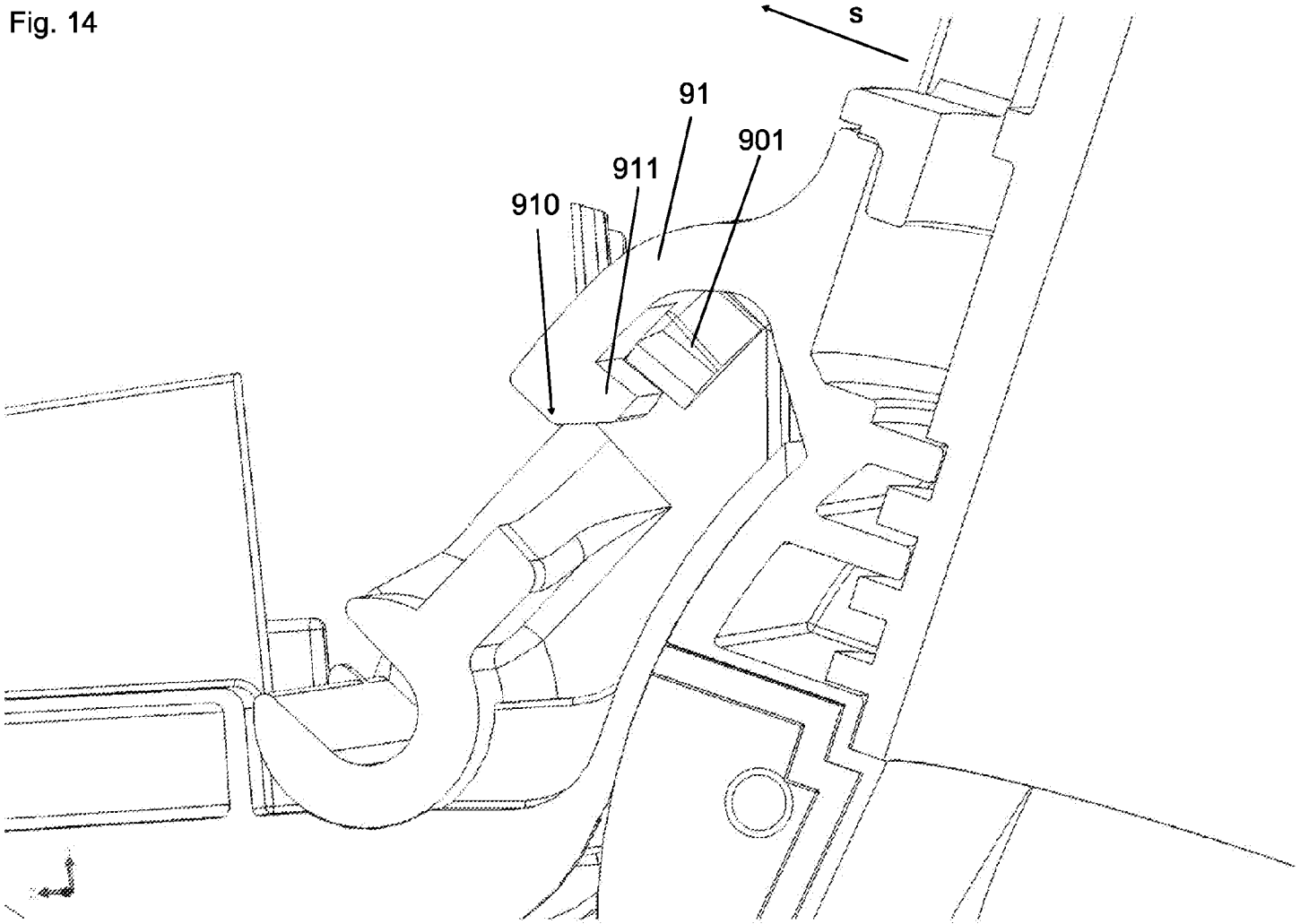

As shown in FIG. 14, during locking the surface 910 slides, due to the movement s, over the hooks 901 or between the hooks 901 and into the locking position, that is, the hooks 901 are pushed apart. On attaining the locking position, the hooks 901 relax and fix the projection 911 in the engaged position.

During unlocking, the engagement of a fourth engagement element 902 and second engagement element 91 is released against the elastic force of the two hooks 901 by exerting force in the direction of the working position. All locking hooks can be rounded in order that locking and/or unlocking may be made easier.

One or more embodiments of the present disclosure may include one or more of the following concepts:

A. A suction head (1) for a vacuum cleaner, comprising a housing (2) with a base unit (21, 22, 23) and a cover element (25) which can be arranged at the base unit (21, 22, 23);

a tilting joint (3) for connecting a connection nozzle (4) to the housing (2) with a bearing (30) arranged at the housing (2) and a pivotable connector piece (31) mounted in the bearing (30);

a locking mechanism (5) for locking the connector piece (31) in a predetermined angular position against pivoting relative to the housing (2); wherein the locking mechanism (5) has a first locking element (50) which is movably connected to the housing (2), and a second locking element (51) which is connected to the connector piece (31) of the tilting joint (3), wherein the first locking element (50) is configured for mutual engagement with the second locking element (51), when the connector piece (31) of the tilting joint (3) is aligned in the predetermined angular position and the first locking element (50) is arranged in a first engagement position at the housing (2); and an actuator (6) for releasing the lock by actuating the actuator (6); wherein the first locking element (50) may be moved by actuation of the actuator (6) from the first engaged position into at least a second unlocked position to release the mutual engagement with the second locking element (51);

the locking mechanism (5) has a return mechanism (7), which moves the first locking element (50) back into the engaged position after actuation of the actuator (6) is complete; and the return mechanism (7) has at least one magnet arrangement (70) for exerting the restoring force from the unlocked position towards the engaged position.

B. The suction head (1) in accordance with claim A, wherein the first locking element (50) is arranged rotatably at the housing (2) about a rotary shaft (D) relative to the housing (2).

C. The suction head (1) in accordance with claim B, wherein the rotary shaft (D) is aligned parallel with a pivot axis (S) of the tilting joint (3).

D. The suction head (1) in accordance with claim A, wherein the first locking element (50) has at least a first engagement element (502) and/or the second locking element (51) has at least a second engagement element for engagement with the other corresponding locking element.

E. The suction head (1) in accordance with claim A, wherein the magnet arrangement has a first magnet (24), which is arranged at the housing (2).

F. The suction head (1) in accordance with claim A, wherein the first locking element (50) is formed as a rocker, which has a rotary shaft (501) which is arranged rotatably at the housing (2).

G. The suction head (1) in accordance with claim A, wherein the first locking element (50) has a magnetic holder (503) for holding a second magnet (504) of the magnet arrangement.

H. The suction head (1) in accordance with claim D, wherein the first locking element (50) has at least one connecting arm (505), which produces a movable connection or coupling between the first engagement element (50) and the actuator (6).

I. The suction head (1) in accordance with claim G or H, wherein the first engagement element (501) extends from the rotary shaft (D) in a first direction, the magnetic holder (503) from the rotary shaft in a second direction, and the connecting arm (505) from the rotary shaft in a third direction.

J. The suction head (1) in accordance with claim A, wherein the suction head (1) has a connection nozzle (4) for connecting a suction pipe, which is coupled to the connector piece (31) of the tilting joint (3), and whose connection portion for the suction pipe can rotate relative to the connector piece (31) of the tilting joint (3).

K. The suction head (1) in accordance with claim J, wherein the suction head (1) has a further locking element (8) for locking the connection nozzle (4) in a predetermined angular position against rotation relative to the tilting joint (3).

L. The suction head (1) in accordance with claim K, wherein the third locking element (8) has a third engagement element (250) arranged at the housing (2) for the purpose of engagement with a complementary engagement element (40) provided at the connection nozzle.

I claim:

1. A suction head for a vacuum cleaner, comprising:

a housing with a base unit and a cover element that can be arranged at the base unit, a tilting joint for connecting a connection nozzle to the housing with a bearing arranged at the housing, and a pivotable connector piece mounted in the bearing;

a locking mechanism for locking the pivotable connector piece in a predetermined angular position against pivoting relative to the housing, wherein the locking mechanism has a first locking element that is movably connected to the housing, and a second locking element that is connected to the pivotable connector piece of the tilting joint, further wherein the first locking element is configured for mutual engagement with the second locking element when the pivotable connector piece of the tilting joint is aligned in the predetermined angular position and the first locking element is arranged in a first engagement position at the housing; and an actuator for releasing the locking mechanism by actuating the actuator; wherein the first locking element may be moved by actuation of the actuator from the first engagement position into at least a second unlocked position to release the mutual engagement with the second locking element;

wherein the locking mechanism has a return mechanism, which moves the first locking element back into the first engagement position after actuation of the actuator is complete, and the return mechanism has at least one magnet arrangement for exerting a restoring force from the second unlocked position towards the first engagement position.

2. The suction head of claim 1, wherein the first locking element is arranged rotatably at the housing about a rotary shaft, relative to the housing.

3. The suction head of claim 2, wherein the rotary shaft is aligned parallel with a pivot axis of the tilting joint.

4. The suction head of claim 1, wherein the first locking element has at least a first engagement element and the second locking element has at least a second engagement element for engagement with the other corresponding locking element.

5. The suction head of claim 1, wherein the at least one magnet arrangement has a first magnet, which is arranged at the housing.

6. The suction head of claim 1, wherein the first locking element is formed as a rocker, which has a rotary shaft that is arranged rotatably at the housing.

7. The suction head of claim 1, wherein the first locking element has a magnetic holder for holding a second magnet of the at least one magnet arrangement.

8. The suction head of claim 7, wherein a first engagement element of the first locking element extends from a rotary shaft in a first direction, the magnetic holder from the rotary shaft in a second direction, and a connecting arm from the rotary shaft in a third direction.

9. The suction head of claim 4, wherein the first locking element has at least one connecting arm, which produces a movable connection or coupling between the first engagement element and the actuator.

10. The suction head of claim 9, wherein the first engagement element extends from the rotary shaft in a first direction, a magnetic holder for holding a second magnet of the at least one magnet arrangement extends from the rotary shaft in a second direction, and the at least one connecting arm extends from the rotary shaft in a third direction.

11. The suction head of claim 1, wherein the suction head has a connection nozzle for connecting a suction pipe, which is coupled to the pivotable connector piece of the tilting joint, and whose connection portion for the suction pipe can rotate relative to the pivotable connector piece of the tilting joint.

12. The suction head of claim 11, wherein the suction head has a third locking element for locking the connection nozzle in a predetermined angular position against rotation relative to the tilting joint.

13. The suction head of claim 12, wherein the third locking element has a third engagement element arranged at the housing for engaging with a complementary engagement element provided at the connection nozzle.

* * * * *